US005161621A

United States Patent [19]

Shlomo

[11] Patent Number: 5,161,621

[45] Date of Patent: Nov. 10, 1992

[54] METHOD OF CONTAINING AND EXTINGUISHING A FIRE

[76] Inventor: Shlomo B. Shlomo, Moshav Tzur Moshe, D.N. Lev Hasharon, Israel

[21] Appl. No.: 651,829

[22] Filed: Feb. 7, 1991

Related U.S. Application Data

[63] Continuation of Ser. No. 290,278, Dec. 27, 1988, Pat. No. 4,991,658, which is a continuation-in-part of Ser. No. 223,986, Jul. 25, 1988, abandoned.

[30] Foreign Application Priority Data

Dec. 22, 1987 [IL] Israel ..... 84924

[51] Int. Cl.[5] ..... A62C 35/02; A62C 35/64; A62C 39/00

[52] U.S. Cl. ..... 169/46; 169/43; 169/9

[58] Field of Search ..... 169/73, 43, 85, 46, 169/62, 47, 9

[56] References Cited

U.S. PATENT DOCUMENTS

| | | | |
|---|---|---|---|
| 2,459,743 | 1/1949 | Trainer et al. | 169/73 |
| 2,549,100 | 12/1951 | Smith | 169/73 |
| 2,767,796 | 10/1956 | Roberts | 169/73 |
| 2,804,929 | 9/1957 | Plummer | 169/73 X |
| 4,345,654 | 8/1982 | Carr | 169/14 X |
| 4,796,788 | 1/1989 | Bond | 222/94 |
| 4,889,189 | 12/1989 | Rozniecki | 169/73 |
| 4,991,658 | 2/1991 | Shlomo | 169/62 |
| 5,063,998 | 11/1991 | Quinn | 169/73 X |

FOREIGN PATENT DOCUMENTS

| | | | |
|---|---|---|---|
| 2036702 | 2/1972 | Fed. Rep. of Germany . | |
| 2546077 | 4/1977 | Fed. Rep. of Germany . | |
| 745902 | 5/1933 | France | 169/62 |
| 0395826 | 7/1933 | United Kingdom . | |
| 0395994 | 7/1933 | United Kingdom . | |
| 1398628 | 6/1975 | United Kingdom . | |
| 2211734 | 7/1989 | United Kingdom | 169/61 |

*Primary Examiner*—Margaret A. Focarino
*Assistant Examiner*—James M. Kannofsky
*Attorney, Agent, or Firm*—Browdy and Neimark

[57] ABSTRACT

A device and a method for fire extinguishing, particularly but not exclusively useful as a fire-extinguisher for vehicles, comprises a rigid tank containing an expansible water chamber for receiving a quantity of water to be used for extinguishing a fire, and an expansible air chamber for receiving pressurized air in order to pressurize the water in the water chamber; a water inlet into the water chamber for introducing water thereinto; an air inlet into the air chamber for introducing pressurized air thereinto for pressurizing the water in the water chamber; a discharge nozzle from said water chamber for discharging water therefrom in the form of a fog jet; and a control valve for controlling the discharge of water from the water chamber through the discharge nozzle.

21 Claims, 3 Drawing Sheets

METHOD OF CONTAINING AND EXTINGUISHING A FIRE

This application is a continuation of parent application Ser. No. 07/290,278 filed Dec. 27, 1988, now U.S. Pat. No. 4,991,658 , itself a continuation-in-part of the now abandoned application Ser. No. 07/223,986, filed Jul. 25, 1988.

BACKGROUND OF THE INVENTION

The present invention relates to a device and a method for fire extinguishing, particularly but not exclusively for vehicles or other devices.

It is strongly recommended that all vehicles be equipped with fire extinguishers, but because of the relatively high costs of existing fire extinguishers, and also because of the need to periodically refill them with expensive fire-extinguisher material, the percentage of vehicles so equipped is relatively low.

An object of the present invention is to provide a device particularly useful as a fire extinguisher for vehicles or other devices, which fire extinguisher can be produced and maintained at relatively low cost. The novel device may be used not only to extinguish fires, but also to protect persons from burns caused by fires.

BRIEF SUMMARY OF THE INVENTION

According to the present invention, there is provided a device particularly useful as a fire-extinguisher for vehicles or other devices, comprising: a rigid tank containing an expansible water chamber for receiving a quantity of water to be used for extinguishing a fire, and an expansible air chamber for receiving pressurized air in order to pressurize the water in the water chamber; a water inlet into the water chamber for introducing water thereinto; an air inlet into the air chamber for introducing pressurized air thereinto for pressurizing the water in the water chamber; a discharge nozzle from the water chamber for discharging water therefrom in the form of a fog jet; and a control valve for controlling the discharge of water from the water chamber through the discharge nozzle.

In the described preferred embodiment, both the water and the air chambers are defined by separate inflatable bags within the rigid tank. Thus, filling one bag with air will increase the pressure applied to the water within the other bag.

Also in the described preferred embodiment, the device further includes a fire and/or smoke detector for automatically actuating the control valve to discharge water via the discharge nozzle; the described preferred embodiment also includes a manual control for manually actuating the control valve.

According to another feature in the described preferred embodiment, the device further includes a pressure detector for automatically disabling the control valve for discharging water from the water chamber via the discharge nozzle in the event the pressure at the inlet of the discharge nozzle is below a predetermined value. The described preferred embodiment further includes a bypass outlet between the water chamber and the discharge nozzle; a bypass valve for controlling the discharge of water via the bypass outlet; and a temperature sensor for controlling the bypass valve to effect a discharge of the water via the bypass outlet in the event the temperature of the water in the water chamber is above a predetermined value.

Another embodiment of the invention is described below wherein there are a plurality of discharge nozzles connected to the water chamber via separate control valves, each of the discharge nozzles including a separate fire and/or smoke detector for automatically actuating its respective control valve. This embodiment permits the discharge nozzles to be placed at different locations where a fire may occur; for example, when the device is used in an automotive vehicle, one nozzle may be placed in the engine compartment, one in the passenger compartment, one in the trunk compartment, etc.

It will thus be seen that the device produces a penetrating fog which not only smothers the flames and cools the space and any persons or objects within the space, but also produces a barrier between the persons or objects within the space, and washes the space of harmful gases or particles. Furthermore, once the device is installed, it can be maintained and refilled at very low cost, by periodically refilling the water chamber with plain water, and periodically refilling the air chamber from an air pump at the standard fuel station. The device is effective in any position of the vehicle. In addition, the water can be used for other purposes, for example, for drinking or washing at picnics and the like, or for arousing oneself if drowsy.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
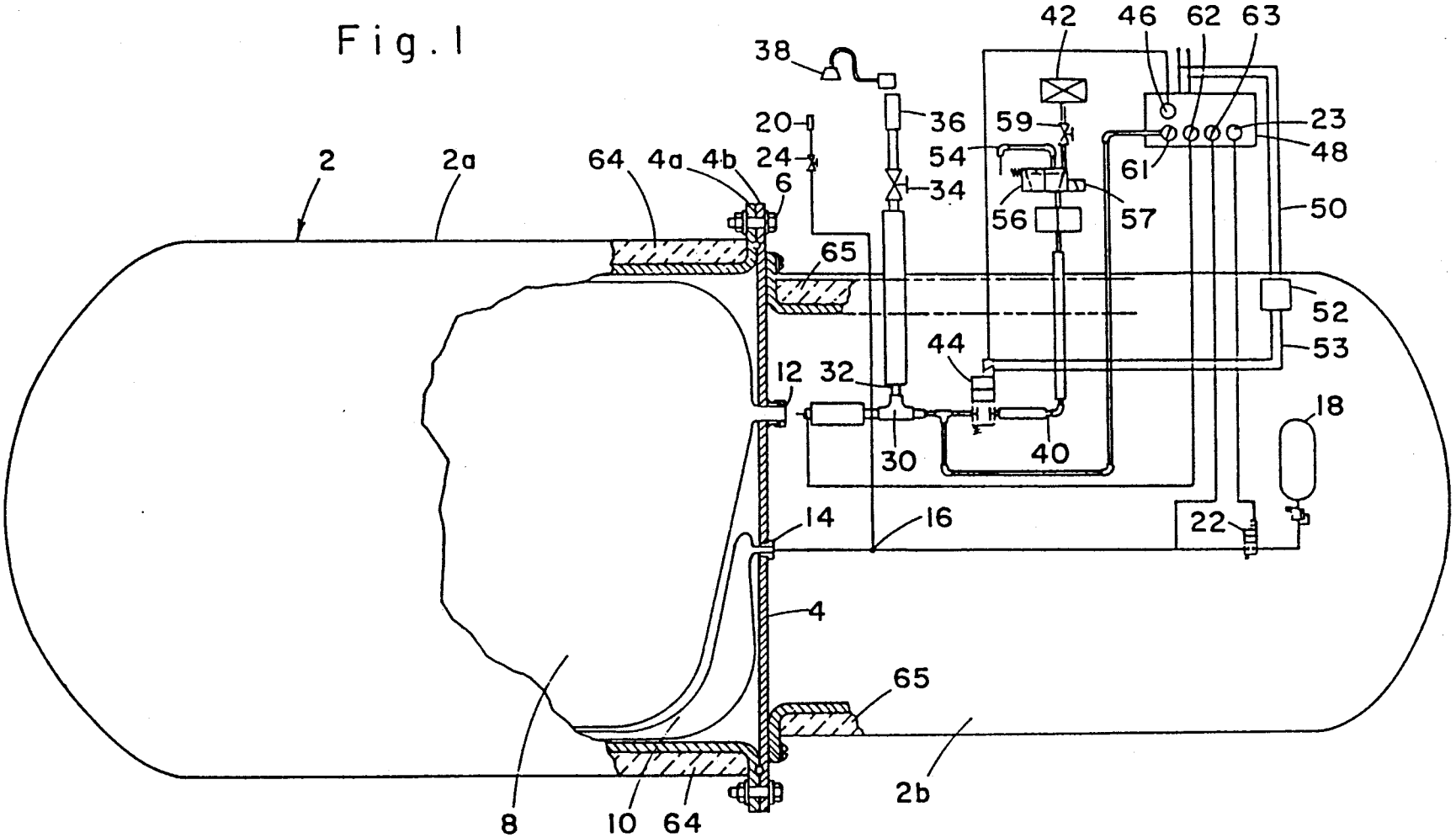
FIG. 1 is a diagrammatical view illustrating one form of device constructed in accordance with the present invention.
Figure 2:
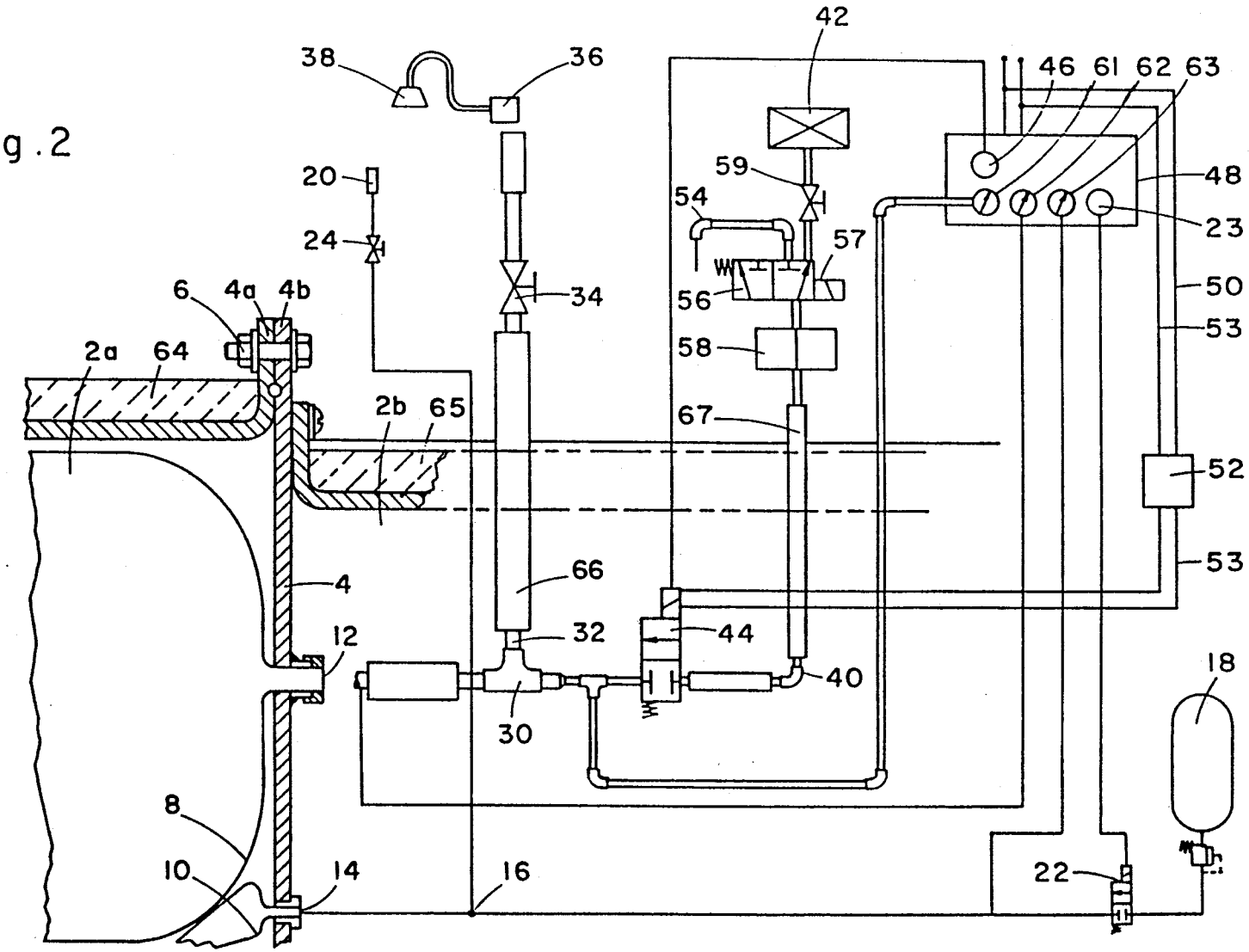
FIG. 2 is an enlarged fragmentary view illustrating a portion of the device of FIG. 1.

The device illustrated in FIGS. 1 and 2 of the drawings is constructed particularly for use as a fire-extinguisher for automotive vehicles. It includes a rigid tank 2, e.g., of metal or strong plastics materials, divided by a partition 4 into two sections 2*a*, 2*b* joined together by flanges 4*a*, 4*b* and bolts 6. Section 2*a* includes two inflatable bags 8, 10. Bag 8 is adapted to receive a quantity of water, whereas bag 10 is adapted to receive air for pressurizing the water within bag 8.

Bag 8 thus defines an expansible water chamber, while bag 10 defines an expansible air chamber. The two chambers 8 and 10 include inlet/outlet fittings 12 and 14, respectively, passing through partition 4 into section 2*b* of the tank. The various connections to these fittings are more particularly illustrated in FIG. 2.

Thus, as shown in FIG. 2, air fitting 14 includes a juncture 16 connected to a pressurized tank 18 and to a coupling 20 to an air pump, such as at the standard fuel station. The connection to the pressurized air tank 18 includes a valve 22 controlled by a manual actuator 23, and the connection to the pump coupling 20 includes another manually-controlled air valve 24. Normally, bag 10 would be periodically refilled from the air pump at the fuel station to a pressure of, e.g., 4 atmospheres, by the use of coupling 20 and its valve 24. Air tank 18 containing a much higher pressure, e.g., 100 atmospheres, boosts the pressure in bag 10 to about 30 atmospheres, and includes a pressure regulator to maintain that pressure.

Fitting 12 to the water bag 8 includes a juncture 30 to which is connected a pipe 32 containing a valve 34. Pipe 32 is normally used for filling bag 8 with water. It can, however, include a coupling 36 adapted to be received over the upper end of the pipe, for connecting the pipe to an auxiliary nozzle, such as a shower head 38, to enable use of the water within bag 8 for purposes other than fire extinguishing, for example, for drinking, washing, or other purposes at picnics and the like.

The water bag fitting 12 is connected to a further pipe 40 carrying a discharge nozzle 42 at its outer end, which nozzle is normally used for discharging the water from bag 8 when the device is used for fire-extinguishing purposes.

A valve 44, e.g., of the electro-mechanical type, controls the discharge of the water via nozzle 42. Valve 44 may be controlled manually by a button 46 carried on a control panel 48 and connected to the valve by an electrical circuit 50; alternatively, valve 44 may be controlled automatically by a smoke, temperature, and/or fire detector 52 also connected to the valve via electrical conductors 53.

The water within bag 8 may become hot, e.g., when exposed to the hot sun for a long period of time or to the head of the flames. To prevent inadvertent injury to a person who may receive the water spray from nozzle 42, a bypass outlet 54 is provided connected to discharge pipe 40 via a temperature-responsive valve 56 which diverts the water to the bypass outlet 54 whenever the temperature of the water within bag 8 is above a predetermined value. Bypass outlet 54 is oriented so as to direct the hot water to the side away from possible contact with a person in the immediate vicinity. The temperature-responsive valve 56 may be disabled by manual button 57.

Pipe 40 leading to discharge nozzle 42 further includes a low-pressure responsive valve 58, which blocks the flow to the discharge nozzle (as well as to the bypass nozzle 54) should the water pressure at the inlet of the discharge nozzle be below a predetermined level. This is to prevent wasting the water within the tank when there is insufficient pressure to produce a useful discharge. A manual valve 59 is further provided to enable manually turning-off the discharge of water from discharge nozzle 42.

The control panel 48 includes, in addition to the manual actuator 23 for air valve 22, and manual actuator 46 for the water valve 44, a meter 61 for measuring and indicating the water pressure, a meter 62 for measuring and indicating the water temperature, and a meter 63 for measuring and indicating the air pressure. Preferably, tank 2 is thermally insulated as indicated by insulation layers 64 and 65 in FIG. 2, and the water pipes 32 and 40 are also thermally insulated as indicated by layers 66 and 67, respectively.

The device illustrated in FIGS. 1 and 2 may be used as an automatic fire extinguisher as follows:

First, the water bag 8 is filled with water via pipe 32 and valve 34 to a desired volume. Air is then introduced into the air bag 10 from an external pump at the gas station via coupling 20 and pipe 32, and the pressure is boosted by the pressurized air in tank 18 to the desired level (e.g., from 4 atmospheres to 30 atmospheres). The pressure is indicated by the water pressure meter 62.

Now, should a fire start, this would be immediately detected by detector 52, which automatically opens valve 54, thereby producing a discharge of water from bag 8 via pipe 40 and the spraying nozzle 42, to extinguish the fire. The discharge of water also provides a protective layer between the fire and the person. Water may also be manually discharged via spray nozzle 42 by manually depressing button 46 on the control panel 48.

The water in bag 8 may also be used for other purposes, e.g., for drinking or washing on a picnic or the like, or for arousing oneself if drowsy. For this purpose, a nozzle, such as a shower head 38, is attached to the upper end of pipe 32 by the quick-coupling 36, and valve 34 is turned on, to produce a discharge of the water through that nozzle.

In case the temperature of the water within the tank is excessively high, the water normally flowing through pipe 40 to the spray nozzle 42 is bypassed to bypass outlet 54 by temperature-responsive valve 56; the hot water discharged is thus diverted away from the immediate vicinity of a person so as not to injure that person.

In case the pressure of the water at the inlet to the discharge 42 nozzle is too low to produce an effective spray or discharge, this is sensed by pressure-sensor 58, which is effective to turn-off valve 44, and thereby to prevent the ineffective discharge of water. Also, the water discharge via nozzle 42 may be turned off by manual valve 59.

Figure 3:
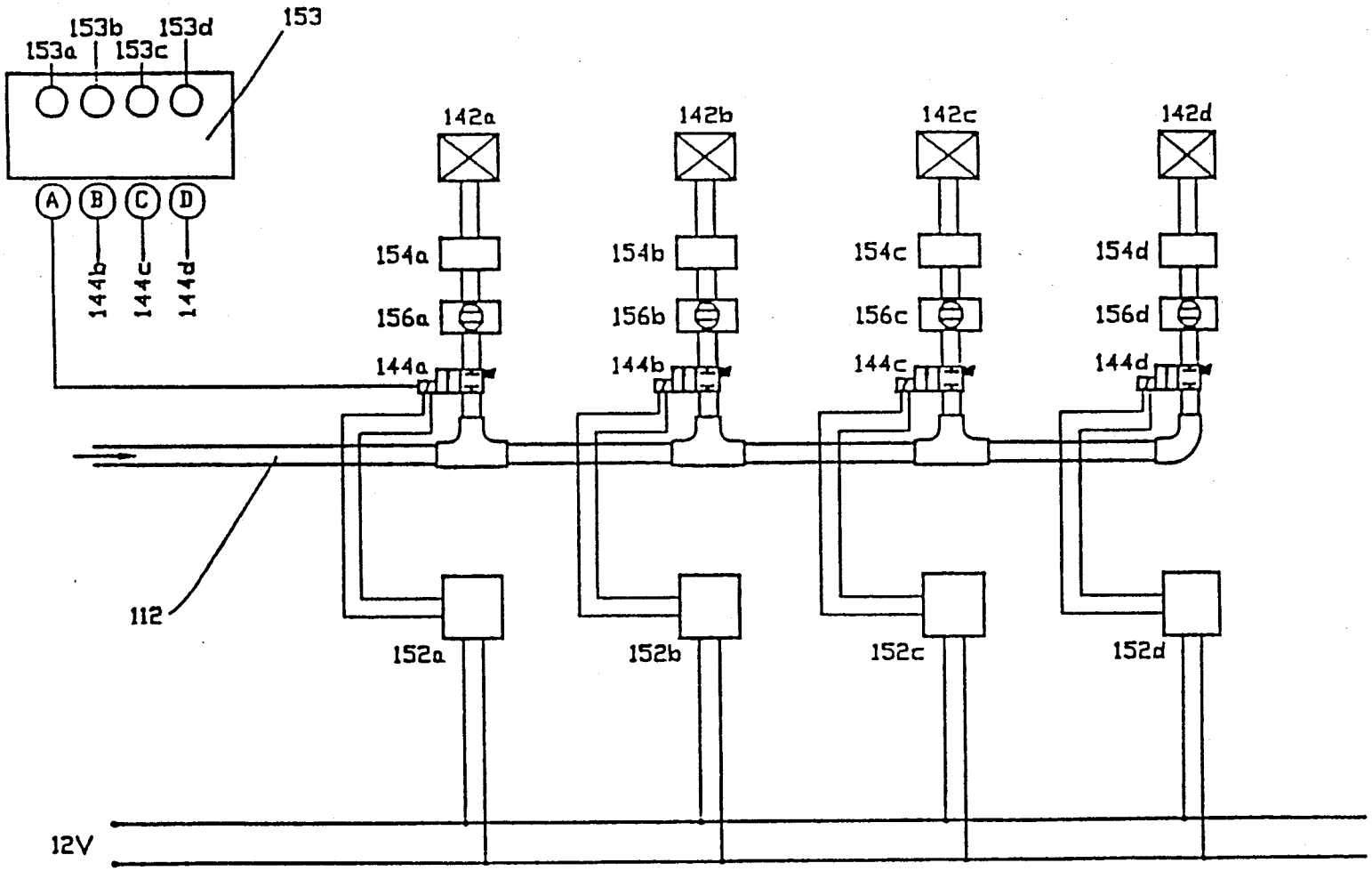
FIG. 3 is a diagrammatical view illustrating a modification that may be included in the device of FIG. 1.

FIG. 3 illustrates a modification wherein a plurality of discharge nozzles are provided, each adapted to be located at a different place, all controlled substantially in the same manner as described above with respect to discharge nozzle 42.

Thus, the device illustrated in FIG. 3 includes a plurality of discharge nozzles **142*a*–142*d*, connected to the water outlet tube 112. Each nozzle is adapted to be placed at a desired location, and each is controlled by its own valve 144*a*–144*d*. Each valve is in turn automatically controlled by a fire/smoke detector 152*a*–152*d*, or manually controlled by a button 153*a*–153*d* on a control panel 153. The pipe to each discharge nozzle further includes a bypass nozzle 154*a*–154*d*, each controlled by a thermally-responsive valve 156*a*–156*d*, as described above with respect to FIG. 1**.

It will be seen that the device can be used to automatically extinguish a fire and also to produce a spray which protects persons from burns caused by a fire. The device is equally effective in any position, e.g., if the vehicle overturns. It can include more than two bags, e.g., one bag for pressurized air, a second bag for pressurized water to produce a spray into the passenger compartment of the vehicle, and a third bag of pressurized mixture producing a foam into the engine compartment of the vehicle. The invention could also be used for other applications. For example, the device could also be used to wash air of harmful gases or particles not accompanied by a fire.

Whilst in the embodiments described above, the application of the invention to a fire extinguisher for an automotive vehicle has been specifically described, the broad concepts of the invention have wider applications. Thus, for example, when these concepts are employed to extinguish a fire such as a fire in a fuel tank, the introduction of a fog of the kind described above and consisting of a high relative concentration of water droplets of minimal size into the tank, in the region above the burning fuel layer so as effectively to cover an area corresponding to the area of the burning, results in the immediate cooling of the region above the burning layer. At the same time, the downward motion of the fog particles results in the entrainment of the combustible particles evaporated from the burning fuel and the progressive confinement of these particles to the region of the upper fuel layer. In this way, the extinguishing of the fire is rapidly effected. At the same time, the downward movement of the fog particles carrying with them the noxious combustible products of the conflagration results in the effective clearing of the upper portions of the tank of such noxious elements. Similarly, the basic concepts of the invention can be applied for the extinguishing of large scale fires (such as forest fires or the like) in which case the fog is arranged to cover successive discrete areas of the fire.

The method of fire extinguishing in accordance with the invention is particularly economical in respect of the amount of water require. Thus, for example, it was found that a fire in a region of approximately 2 cubic metres could be effectively extinguished using only one litre of water.

This phenomenon, involving the generation of a fog consisting of a high relative concentration of water droplets of minimal size, can also be applied for the decontamination of an enclosed or open region from noxious gases or the like (whether these are the products of combustion or otherwise). Thus, the inventive concept can be applied to the decontamination or cleansing of the region, by the introduction into that region, under pressure, of a relatively high concentration of water droplets of minimal size so as to generate an effective fog blanket in the region, and displacing the fog blanket through the region so as to entrain and displace contaminant particles out of a progressively increasing volume of the region.

Thus, the method in accordance with the invention can be used to provide protection in the event of a gas attack. In such an event and in order to ensure protection for a period sufficient for personnel to escape from the region under attack, the generation of the fog blanket effectively prevents the gas reaching the area protected by the fog blanket.

It will be appreciated that external and, where required, powerful energy sources may be provided for the generation of the fog for those situations where the fog is to be used for fire extinguishing conflagrations over large areas or the purification or protection of large regions from noxious gases.

What is claimed is:

1. A method for combatting fire and an accumulation of noxious gases in a region comprising the steps of applying and maintaining compressed air at a pneumatic pressure of a magnitude not less than a predetermined minimum to a quantity of liquid located in a chamber, to force said liquid only without any air mixed therewith out of one or more outlet nozzles of said chamber in the form of liquid droplets minimal size, and to form a fog of said droplet of high droplets concentration and minimal air content and to displace said fog under high pressure into said region so as to generate an effective dense fog blanket in the region so as to cool the region and isolate, filter, entrain and displace combustible or contaminant particles.

2. A method according to claim 1, wherein the compressed air is applied to the liquid via an interposed displaceable barrier serving to prevent direct contact between the compressed air and said liquid.

3. A method according to claim 1, wherein the pneumatic pressure is between 25 and 40 atmospheres.

4. A method according to claim 1, wherein the pneumatic pressure is at least about 30 atmospheres.

5. A method according to claim 1, further comprising the step of interrupting discharge of liquid through said nozzles when said pneumatic pressure falls below said predetermined minimum.

6. A method according to claim 1, comprising inflating an expandable air chamber to said predetermined minimum air pressure, so as to cause said air chamber to expand with respect to said liquid so as to force said liquid out of said nozzles, and maintaining said predetermined air pressure in said air chamber.

7. A method according to claim 1, wherein said liquid is located in an expandable bag within said chamber.

8. A method of containing and extinguishing a fire comprising the steps of applying and maintaining compressed air at a pneumatic pressure of a magnitude not less than a predetermined minimum to a quantity of fire extinguishing liquid located in a chamber, thereby forcing liquid out of one or more outlet nozzles of said chamber in the form of only liquid droplets of minimal size without any air mixed therewith, said droplets on exiting from the nozzle forming a fog of high droplet concentration and minimal air content and displacing said fog under high pressure towards said fire and through a region bounded by the fire so as to generate an effective dense fog blanket to cool the region and to entrain combustible particles in said region.

9. A method according to claim 8, wherein the compressed air is applied to the liquid via an interposed displaceable barrier serving to prevent direct contact between the compressed air and said liquid.

10. A method according to claim 8, wherein the pneumatic pressure is between 25 and 40 atmospheres.

11. A method according to claim 8, wherein the pneumatic pressure is at least about 30 atmospheres.

12. A method according to claim 8, further comprising the step of interrupting discharge of liquid through said nozzles when said pneumatic pressure falls below said predetermined minimum.

13. A method according to claim 8, comprising inflating an expandable air chamber to said predetermined minimum air pressure, so as to cause said air chamber to expand with respect to said liquid so as to force said liquid out of said nozzles, and maintaining said predetermined air pressure in said air chamber.

14. A method according to claim 8, wherein said liquid is located in an expandable bag within said chamber.

15. A method of decontaminating a region of noxious gases comprising the steps of applying and maintaining compressed air at a pneumatic pressure of a magnitude not less than a predetermined minimum to a quantity of decontaminating liquid located in a chamber to force only said liquid without any air mixed therewith out of one or more outlet nozzles of said chamber in the form of liquid droplets of minimal size, said droplets on exiting from the nozzle forming a fog of high droplet concentration and minimal air content, and displacing said fog under high pressure into said region so as to generate an effective dense fog blanket in the region and displacing the fog blanket through the region so as to isolate, filter, entrain and displace contaminant particles out of a progressively increasing volume of the region.

16. A method according to claim 15, wherein the compressed air is applied to the liquid via an interposed displaceable barrier serving to prevent direct contact between the compressed air and said liquid.

17. A method according to claim 15, wherein the pneumatic pressure is between 25 and 40 atmospheres.

18. A method according to claim 15, wherein the pneumatic pressure is at least about 30 atmospheres.

19. A method according to claim 15, further comprising the step of interrupting discharge of liquid through said nozzles when said pneumatic pressure falls below said predetermined minimum.

20. A method according to claim 15, comprising inflating an expandable air chamber to said predetermined minimum air pressure, so as to cause said air chamber to expand with respect to said liquid so as to force said liquid out of said nozzles, and maintaining said predetermined air pressure in said air chamber.

21. A method according to claim 15, wherein said liquid is located in an expandable bag within said chamber.

* * * * *